United States Patent [19]

Noschese

[11] Patent Number: 4,718,857

[45] Date of Patent: Jan. 12, 1988

[54] ELECTRICAL CONNECTORS AND CLIPS AND METHODS OF USE

[75] Inventor: Rocco Noschese, Wilton, Conn.

[73] Assignee: Burndy Corporation, Norwalk, Conn.

[21] Appl. No.: 37,047

[22] Filed: Apr. 10, 1987

[51] Int. Cl.[4] ..... H01R 13/28

[52] U.S. Cl. ..... 439/292; 439/351; 439/355; 439/358; 439/555

[58] Field of Search ..... 439/345, 350, 351, 352, 439/353, 354, 355, 357, 358, 368, 527, 529, 540, 544, 549, 552, 555, 557, 567, 284, 291, 292, 293

[56] References Cited

U.S. PATENT DOCUMENTS

| | | | |
|---|---|---|---|
| 3,753,212 | 8/1973 | Yamada et al. | 439/358 |
| 3,829,821 | 8/1974 | Derr et al. | 439/353 |
| 3,854,790 | 12/1974 | Provinsky | 439/540 |
| 4,073,563 | 2/1978 | Bailey et al. | 439/557 |

*Primary Examiner*—Gil Weidenfeld
*Assistant Examiner*—David Pirlot
*Attorney, Agent, or Firm*—Perman & Green

[57] ABSTRACT

The combination of a plurality of like connectors and a pair of clips coupling together the connectors in a stack. Each of the connectors comprises a housing fabricated of an electrically insulating material and is shaped with parallel upper and lower surfaces and with spaced front and rear faces and with spaced edges. Each housing has resilient edge latches positioned adjacent its edges with each edge latch having an extent movable toward the housing upon the application of pressure and resiliently movable away from said housing upon the removal of the pressure. Each of the clips comprises sections formed in a U-shaped configuration. Each pair of clips is positionable in operative association with the edge latches of a plurality of connectors in a stack so as to couple together the connectors of their associated stack and to apply an inwardly directing compressive pressure to a plurality of edge latches in the stack whereby only one edge latch along each edge of a stack of connectors is resiliently biased outwardly. Also disclosed are the clips, per se, and the method of using the connectors and clips.

21 Claims, 6 Drawing Figures

ELECTRICAL CONNECTORS AND CLIPS AND METHODS OF USE

BACKGROUND OF THE INVENTION

1. Field of the Invention

This invention relates to connectors and clips and, more particularly, to a stacked assembly of connectors with associated clips as well as to the clips per se and their method of use.

2. Description of the Prior Art

In electrical arts it is often desirable to releasably connect electrical contacts of one member with electrical contacts of another member. By way of example, it is often desirable to terminate a ribbon cable with a connector and then releasably couple that connector with a mating receptacle of an electronic machine. The connector secured to the ribbon cable might normally be provided with female contacts whereas the electronic machine would be provided with male contacts projecting therefrom in a predetermined array. The electronic machine might be a computer, telecommunications device or the like. Inasmuch as various electronic machines may be provided with different numbers of rows and columns of male contacts for being coupled, it has been found desirable to provide connectors with modular capabilities whereby the connectors may be assembled on site for coupling to electronic machines having any number of contacts in an array. As can be understood, the modularity of connectors extends the utility of ribbon cables as well as the electronic machines to which they are to be coupled.

Connectors which are presently known an utilized for these general purposes are traditionally deficient in many aspects. For example, they do not provide the desired ease of coupling and uncoupling of a single connector to a machine. They do not provide the desired ease of coupling and uncoupling of a plurality of connectors, one with respect to the other, into an assembly. Further, they do not provide the desired ease of coupling and uncoupling of an assembled stack of connectors with respect to an electronic machine with which they are to be utilized.

None of the known prior devices, whether commercial, in the patent literature or otherwise, teaches nor suggests the accurate, efficient, convenient, and economical connectors and clips and methods of use as described herein. All known methods, connectors and clips are simply lacking in one regard or another.

As illustrated by the great number of prior patents and commercial devices, efforts are continuously being made in an attempt to releasably connect electrical members more efficiently. None of the prior efforts, however, suggests the present inventive combination of method steps and component elements arranged and connfigured for coupling electrical members as disclosed and claimed herein. Prior methods and component elements do not provide the benefits attendant with the connectors and clips and methods of the present invention. The present invention achieves its purposes, objectives and advantages over the prior art through a new, useful and unobvious combination of method steps and component elements, through the use of a minimum number of functioning parts, at a reduction in cost to manufacture and employ, and through the utilization of only readily available materials and conventional components.

These objects and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings.

SUMMARY OF THE INVENTION

The present invention is defined by the appended claims with the specific preferred embodiments shown in the attached drawings. For the purposes of summarizing the invention, the invention may be incorporated in the combination of a plurality of like connectors in an aligned stack and a pair of clips coupling together the connectors. Each of the connectors comprises a housing molded of an electrically insulating material and shaped with parallel upper and lower surfaces and with spaced front and rear faces and with spaced edges. A plurality of apertures are formed into the front face in a linear array with their axes in a plane parallel with and between the upper and lower surfaces. An electrically conductive female contact is located in each of the apertures and is adapted to receive associated electrically conductive male contacts. Each housing has a latch plate secured to its upper surface with resilient edge latches positioned adjacent its edges and within its plane. Each edge latch has a central extent movable toward the housing upon the application of pressure and resiliently movable away from the housing upon the removal of the pressure. Each clip of the pair of clips comprises an internal section, an external section parallel with the internal section and an intermediate section joining the internal and external sections in a U-shaped configuration. Each clip also is positioned with its internal and external sections positioned in association with edge latches along one edge of the plurality of connectors in the aligned stack so as to couple together the connectors and to apply an inwardly directing compressive pressure to a plurality of edge latches in the stack whereby only one edge latch along each edge of the stack is resiliently biased outwardly for the removable coupling of the stack of connectors and their clips to an associated electronic machine.

The clips of the pair of clips may be identically shaped whereby, when positioned in association with the stack of connectors, the edge latch of the uppermost connector along one edge of the stack and the edge latch of the lowermost connector along the other edge of the stack are resiliently biased outwardly. The clips of the pair of clips may be similarly shaped whereby, when positioned in association with a stack of connectors, the edge latches of the uppermost connector of the stack are resiliently biased outwardly.

The present invention may also be incorporated in the combination of a plurality of connectors and a plurality of clips for coupling together the connectors in a stack. Each of the connectors comprises a housing fabricated of an electrically insulating material and shaped with parallel upper and lower surfaces, spaced front and rear faces, and spaced edges. Each housing has resilient edge latches positioned adjacent its edges. Each edge latch has an extent movable toward the housing upon the application of pressure and resiliently movable away from the housing upon the removal of the pressure. Each of the clips comprises sections formed in a U-shaped configuration. Each pair of the clips is positionable in operative association with the edge latches of a plurality of connectors in a stack so as to couple together the connectors and to apply an inwardly directed compressive pressure to a plurality of edge latches in the stack whereby one edge latch along each edge of a stack of connectors may be resiliently biased outwardly.

Each of the connectors includes a plurality of apertures formed into the front face in a linear array between the upper and lower surfaces and an electrically conductive female contact located in each of the apertures and adapted to receive associated electrically conductive male contacts. The combination further includes a plate secured to one of the surfaces of each housing with the edges of each plate formed as the edge latches. Each clip comprises an internal section, an external section parallel with the internal section and an intermediate section joining the internal and external sections to form the U-shaped configuration. The combination further includes parallel ridges formed in one of the parallel sections facing toward the other of the parallel sections for separating the connectors of the stack to be coupled. The combination further includes additional parallel ridges formed in one of the parallel sections at its upper and lower edges and facing toward the other of the parallel sections for coupling the uppermost and lowermost connectors of the stack to be coupled. The clips of each pair of clips may be identically shaped with their internal sections extending vertically to a height less than the vertical height of the stack of connectors to be coupled whereby, when positioned in association with a stack of connectors, the edge latch of the uppermost connector along one edge of the stack and the edge latch of the lowermost connector along the other edge of the stack may be resiliently biased outwardly. The clips of each pair of clips may be similarly shaped with their internal sections extending upwardly vertically to a height less than the vertical height of the stack of connectors to be coupled whereby, when positioned in association with a stack of connectors, the edge latches of the uppermost connector of the stack may be resiliently biased outwardly. The combination further includes an exteriorly directed notch formed in each latch means for receiving a locking finger when the stack is received by an electronic machine.

In addition, the invention may be incorporated into an improved clip means for use in combination with a plurality of connectors. The connectors are of the type formed with a housing molded of an electrically insulating material and shaped with parallel upper and lower surfaces, spaced front and rear faces, and spaced edges. A plurality of electrically conductive contacts are located in the front face adapted to couple with associated electrically conductive contacts. Each of the housings has resilient edge latches positioned adjacent its edges. Each of the edge latches has a central extent movable toward the housing upon the application of force and resiliently movable away from the housing upon the relieving of the force. The improved clip means comprises an internal section, an external section parallel with the internal section and an intermediate section joining the internal and external sections in a U-shaped configuration. Each pair of the clips is positionable with its internal and external sections in operative association with the edge latches of a plurality of connectors in a stack so as to couple together the connectors of their associated stack and to apply an inwardly directing compressive force to a plurality of edge latches in the stack of connectors whereby one edge latch along each edge of a stack of connectors is resiliently biased outwardly for the coupling of the stack of connectors to an associated electronic machine.

The clip means further includes parallel ridges formed in the exterior sections facing toward the interior section for separating the connectors of the stack to be coupled. The clip means further includes parallel ridges formed in the exterior sections at their upper and lower edges and facing toward the interior sections for coupling to the stack of connectors the uppermost and lowermost connectors to the stack being coupled.

The clip means of each pair of clips may be identically shaped whereby, when positioned in association with a stack of connectors, the edge latch of the uppermost connector along one edge of the stack and the edge latch of the lowermost connector along the other edge of the stack are resiliently biased outwardly. The clip means of each pair of clips may be similarly shaped whereby, when positioned in association with a stack of connectors, the uppermost edge latch of each edge of the stack are resiliently biased outwardly.

Lastly, the invention may be incorporated into a method of coupling together, with clips, a plurality of like connectors in a stack. The method includes the steps of: (1) providing a plurality of connectors, each of the connectors comprising a housing molded of an electrically insulating material and shaped with parallel upper and lower surfaces, spaced front and rear faces, and spaced edges, each housing having resilient edge latches positioned adjacent its edges, each edge latch having an extent movable toward the housing upon the application of an inwardly directed force and resiliently movable away from the housing upon the relieving of the force; (2) placing a plurality of the like connectors in a stack; (3) providing a pair of clips, each of the clips comprising sections formed in a U-shaped configuration; (4) positioning the pair of clips in operative association with the edge latches of a plurality of connectors in a stack to apply an inwardly directed force to a plurality of edge latches in the stack whereby only one edge latch along each edge of the stack is resiliently biased outwardly. The method further includes the step of inserting the stack of connectors with its pair of clips into operative engagement with an electronic machine having fingers to contact the edge latches and apply a force thereto tending to preclude withdrawal of the stack of connectors and its clips. The method further includes the step of applying an inwardly directed force to the edge latches contacted by the fingers to disengage the edge latches from the fingers and thereby remove the force tending to preclude withdrawal of the stack of connectors and its clips from the electronic machine. The method further includes the step of withdrawing the stack of connectors and its clips from operative engagement with the electronic machine.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art that the conception and the specific embodiments disclosed herein may be readily utilized as a basis for modifying or designing other methods and apparatus for carrying out the same purposes of the present invention. It should also be realized by those skilled in the art that such equivalent methods and apparatus do not depart from the spirit and scope of the present invention as set forth in the appended claims.

BRIEF DESCRIPTION OF THE DRAWINGS

For a more complete understanding of the nature, objects and advantages of the present invention, reference should be had to the following detailed description taken in conjunction with the accompanying drawings in which.

Similar reference numerals refer to similar parts throughout the several Figures.

DETAILED DESCRIPTION OF THE INVENTION

Figure 1:
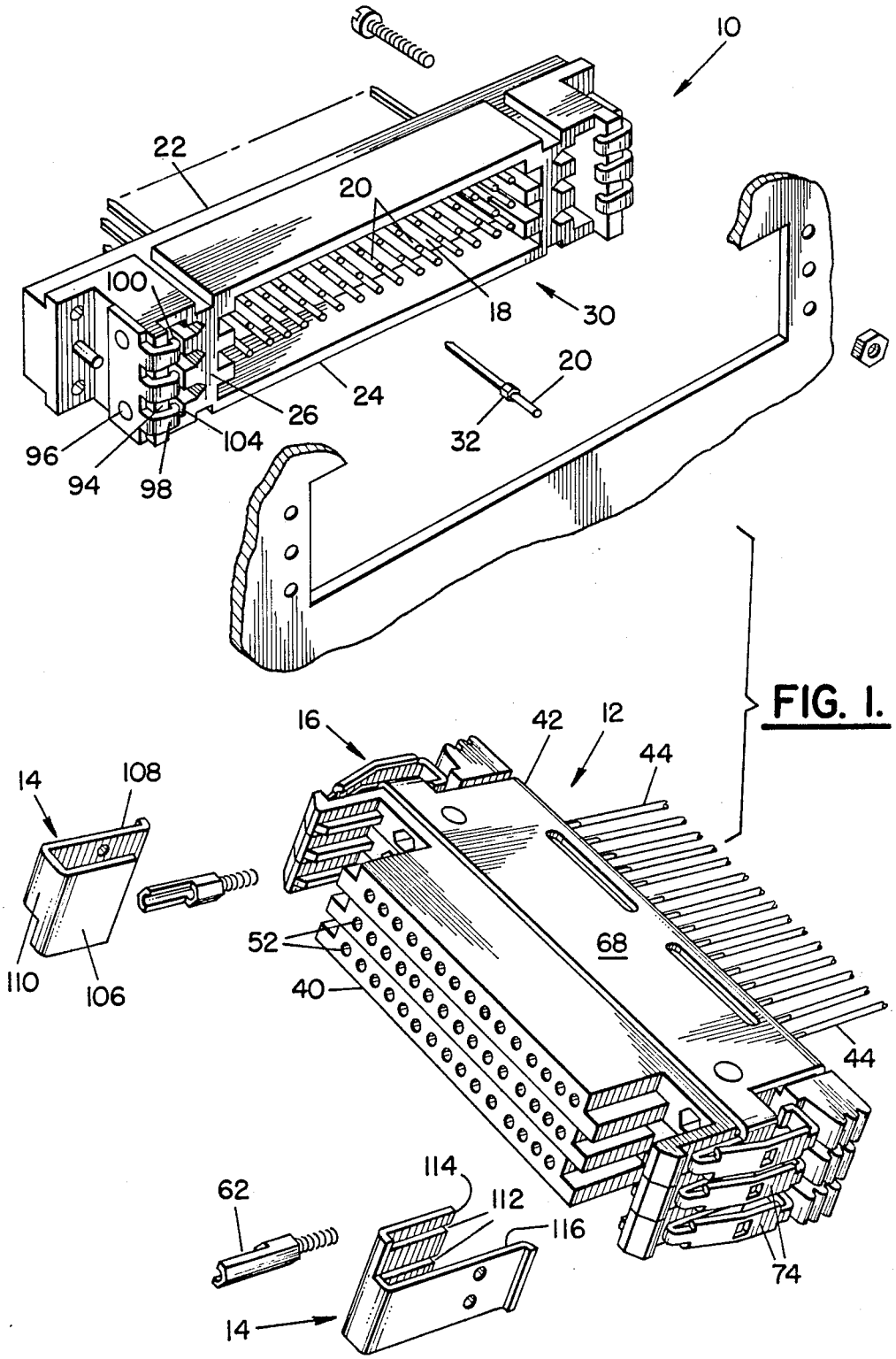
FIG. 1 is an exploded perspective illustration of a portion of an electronic machine with male contacts in combination with stacked connectors and clips constructed in accordance with the principles of the present invention.

Shown in FIG. 1 is an exploded view of a portion of an electronic machine 10 in combination with the connectors 12 and clips 14 constructed in accordance with the primary embodiment of the present invention. The environment in which the invention is shown includes a plurality of connectors 12 in a stack and with associated clips 14 as well as the electronic machine 10 to which the connector 12 is to be coupled. When coupled, the stacked connectors and their clips constitute a multi-module plug connector assembly 16.

The electronic machine 10 includes, on a free face 18 thereof, a plurality of male electrical pin contacts 20 symmetrically spaced in rows and columns and mounted in an insulating base 22 and peripheral walls 24 and 26 surrounding the pin contacts for safety purposes. The contacts and walls constitute the receptacle 30. The number of rows and columns of pin contacts will dictate the number of apertures and female contacts in the adjacent face of the stack of connectors 12. Each male pin contact 20 has an enlarged central section 32 to facilitate replacement and proper positioning of broken or defective contacts. The connectors will be selected so that each has a row of apertures equal to the number of pin contacts in each row of the electronic machine. The number of connectors in each column of the stack will correspond to the number of columns of contacts in the machine. For the sake of illustrative purposes only, the disclosed embodiment employs 15 contacts in each row and three contacts in each column for a total of 45 contacts. These numbers are arbitrarily selected since any numbers, greater or lesser could readily be employed.

Each connector 12 includes a housing 34 fabricated of a high-impact, electrically insulating plastic. Each has an upper surface 36 and a lower surface 38 parallel with each other. Each also has a front face 40 adapted to be brought into contact with the electronic machine and an opposed rear face 42 adapted to receive the electrical wires 44 of the ribbon cable 46 or other electronic component. The front and rear faces extend vertically to couple the upper and lower surfaces. Opposed end faces or edges 50 are also provided to couple the upper and lower surfaces and the front and rear faces. The front face 40 of each connector is provided with a predetermined number of apertures 52 in rows and columns selected to correspond with the number of rows and columns of pins 20 extending outwardly from the electronic machine. Preferably each connector has a single row of apertures for greatest flexibility of design. Each aperture is provided with a female signal contact 54 to receive a male pin contact 20 of the electronic machine at the front face 40 of the connector and to receive the wire 44 from the ribbon cable 46 at the rear face 42 of the connector.

Figure 2:
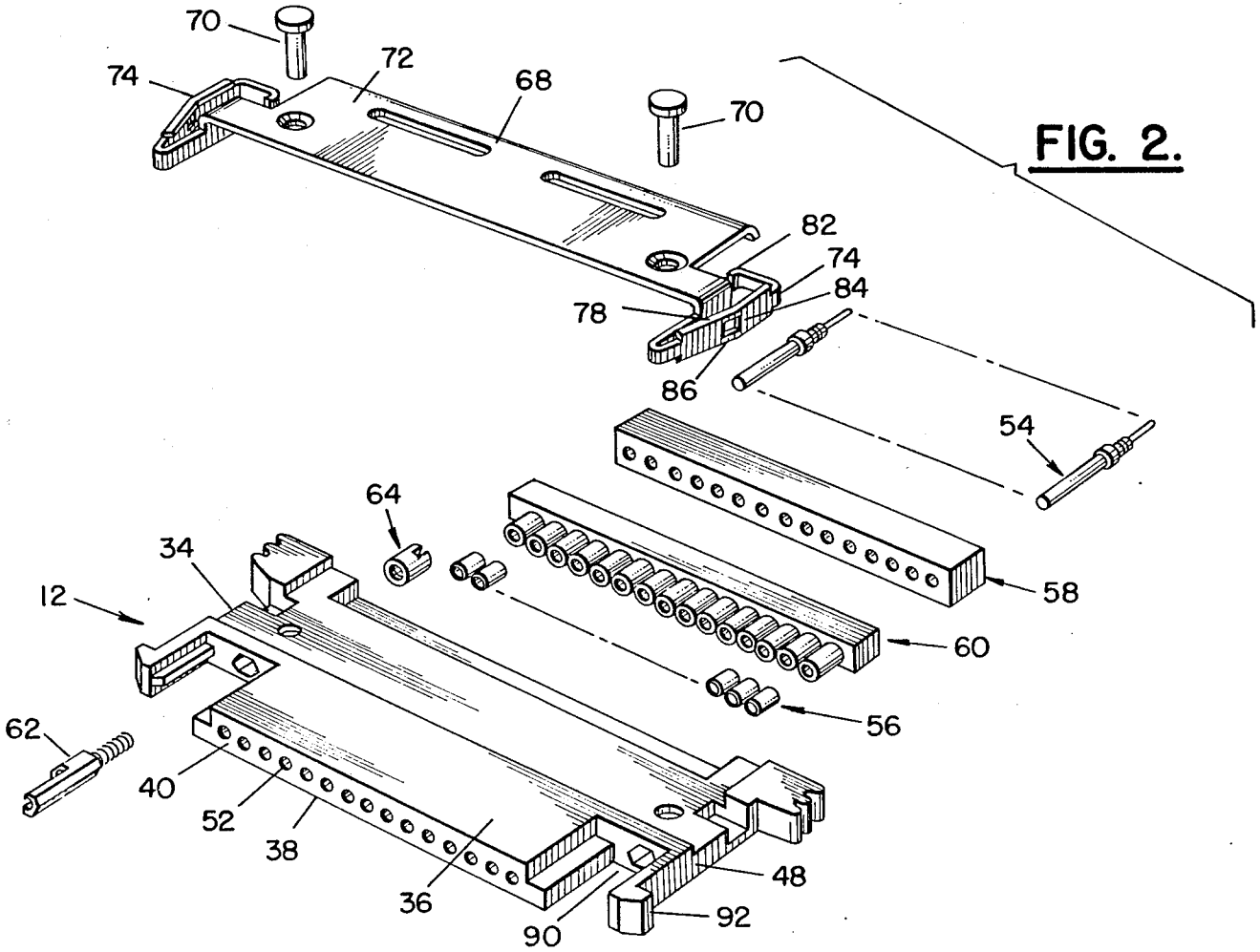
FIG. 2 is an exploded perspective illustration of a single connector of the type as shown in FIG. 1.
Figure 3:
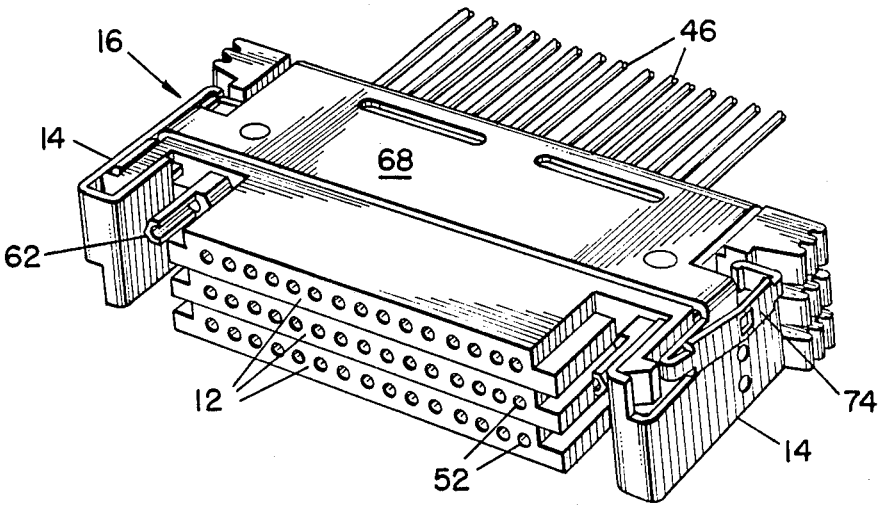
FIG. 3 is a perspective illustration of the stack of connectors as shown in FIG. 1 but with the connectors coupled with clips.
Figure 3A:
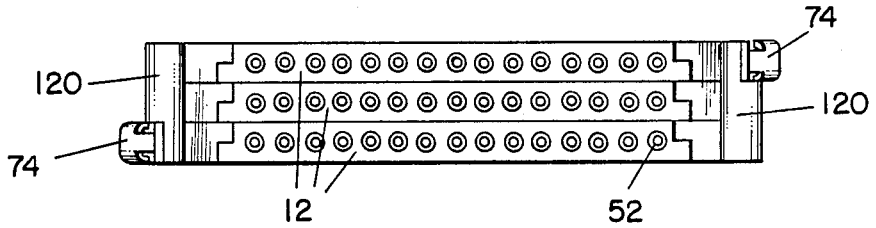
FIG. 3*a* is a front plan view of FIG. 3.
Figure 4:
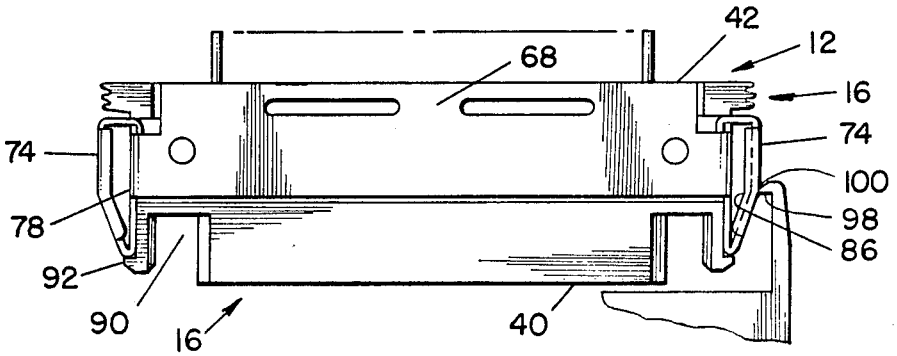
FIG. 4 is a plan view of the stack of connectors and clips shown in FIG. 1 but coupled with the electronic machine.

FIG. 2 shows the apertures 52 in front face 40 of one of the connector housings 34. The apertures extend longitudinally from the front face where they receive the male signal contacts 20 of the electronic machine, all the way through the connector housing 34 to the rear face 42 where they receive the wires as of a ribbon cable. Located within each aperture is, of course, the female type electrical contact 54 as well as their contact retaining springs 56. Other conventional components included within each connector housing 34 are the wire grommet seal 58 and the contact spring retainer 60. Each connector also includes two connector housing discrimination keys 62 and their associated round nuts 64 for coupling together the various component elements of each connector housing. Since the makeup of each connector housing is essentially the same and somewhat conventional, detailed descriptions herein are not deemed necessary.

As used herein the terms upper and lower, horizontal and vertical, and the like are used for descriptive purposes only. It should be readily appreciated that the multi-module plug connectors could be used in any vertical, horizontal, or angular orientation without departing from the spirit or scope of the invention. Such descriptive language herein should, in no way, be construed as limiting the invention in any manner.

Each connector housing is provided with a latch plate 68 secured as by rivets 70 or the like to its upper surface 36. The latch plate 68 is generally planar in its design along its central extent 72 and includes at its ends outwardly extending edge latches 74. The edge latches are preferably formed as extensions of the central extent of the latch plate. Each edge latch has one end 78 secured to a downwardly turned extension 80 of the latch plate and also has a free end 82 whereby a vertical central extent 84, essentially parallel with the edges of the connector housing, may be resiliently urged inwardly toward the housing and the central portions of the connector by a pressure or force. Each edge latch 74 may, therefore, be urged inwardly to effectively decrease the width of the connector from edge to edge. The relief of the pressure or force will allow the edge latches to resile and assume the extended positions as shown in FIG. 1. In addition, the central extent 84 of each edge latch is provided with a notch 86 to assist in coupling to the electronic machine as will be later described. Recesses 90 are formed adjacent the edges of the connectors to form forwardly projecting arms 92 in the connector housing.

Turning now to the electronic machine 10, it is noted that outwardly spaced from the end walls 26 surrounding the pin contacts 20 is a supplemental wall 94 provided with plates 96 having inwardly extending fingers 98 equal in number to the number of connectors in the stack. The fingers have inwardly projecting ends 100 located such that the insertion of a stack of connectors 12 into the receptacle 30 of the electronic machine will position the arms 92 of the connectors into the slots 104 between the end walls 26 and supplemental walls 94 to thus allow the ends 100 of the fingers to apply pressure to the edge latches 74 inserted into the slots. The notches 86 formed on the edge latches 74 will, thereby, be engaged by the ends 100 of the fingers 98 to apply a force and mechanical interference tending to preclude the withdrawing of the stack of connectors therefrom. The distance between the notches 86 and the front face 40 of the connectors along the central extend to the stack of connectors is such that the ends of the fingers will engage the notches when the front face of the connectors is in contact with the mating face 18 of the electronic machine. In this orientation, the pin contacts 20 of the electronic machine will be received by the apertures 52 and female contacts 54 of the connectors for a secure electrical and mechanical contact therebetween. The end wall 26 of the receptacle are received within recesses 90 of the connectors.

Withdrawal of the stack of connectors from engagement with an electronic machine and its pin contacts is effected by an operator providing an inwardly directed pressure against the central extends 84 of the edge latches 74 remote from the front face. The pressure applied by the operator will separate the notches from the ends of the fingers to relieve the pressure and mechanical interference holding the stack of connectors in operative engagement with the electronic machine. This will allow the withdrawal of the stack of connectors. Unfortunately, however, when the number of connectors in the stack is large, manual dexterity would be required to apply an inwardly directed pressure to each and every one of the edge latches simultaneously as would be required to effect connector withdrawal. To that end, the multi-module plug clips 14 are provided.

As shown in FIGS. 1, 3, 3*a* and 4, each clip 14 has an interior section 106 and an exterior section 108 interconnected with a coupling intermediate section 110. The interior section of each clip is of a height corresponding to the height of the connectors in a stack to be joined. Interior ridges 112 are formed projecting to the center of the clips from the interior face for being received between the connectors of the stack. Upper and lower ridges 114 and 116 secure together the uppermost and lowermost connectors of the stack The intermediate section 110 is of a width whereby the spacing between the interior and exterior portions of the clip will function to apply a compressive force or pressure to the arms 92 of the connectors and to the edge latches 74. The interior section 106 extends rearwardly from the intermediate section 110 a distance essentially equal to the recess 90. The exterior section 108 extends rearwardly a greater distance for disabling edge latches 74 as intended. In order, however, to retain the coupling function of the edge latches, the height of the exterior portion of each clip is less than the height of the interior portion. In this manner, when clips are provided to the opposite edges of the stack of connectors, one edge latch on each edge of the stack of connectors will be free to expand and contract for providing the latching or retention function in association with the fingers of the electronic machine. The remaining edge latches on both sides of the stack of connectors will, however, be compressed by the clip so that their associated compressed fingers cannot provide the retention function. The compression will continue so long as the clips are in place. In this manner, the insertion of a stack 16 of connectors into operative position on the electronic machine will result in but a single finger on each edge of the stack of connectors providing the retention function. Withdrawal of the stack of connectors may, therefore, be provided by simply contracting but a single edge latch at each edge of the stack of connectors. Manual dexterity is thus reduced for the coupling and uncoupling of connectors from the electronic machine.

Figure 5:
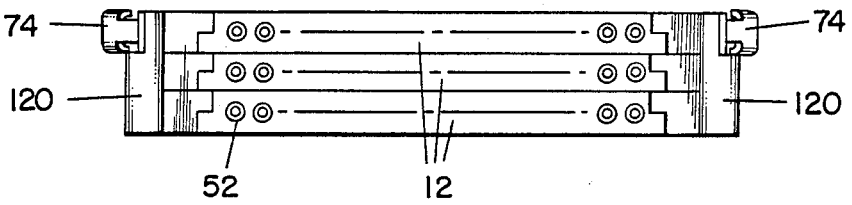
FIG. 5 is a front plan view of a stack of connectors and clips similar to that shown in FIG. 3*a* but illustrating clips constructed in accordance with an alternate embodiment of the invention.

Shown in FIG. 5 is an alternate embodiment of the invention wherein the associated clips 120 are similar in construction. It is noted that the clips of the primar embodiment were identical in construction so that the edge latch along one edge of the top connector and the edge latch along the opposite edge of the bottom connector of each stack had their edge latches exposed for the coupling function. In the alternate embodiment, however, the plug clips are similar in design. As a result, any stack of connectors will have its topmost edge latches exposed for the coupling function. The design of the primary embodiment allows an operator to use any two clips with any stack so long as they are of a height to receive the predetermined number of connectors within the stack. In the alternate embodiment, it would be necessary not only to have clips of the proper height but also to use clips of the proper orientation, a left sided clip and right sided clip.

The nature of the single connector is such that its edge latches are designed so that as the connector is pushed into the receptacle of the electronic machine 10, the edge latches 74 will couple with the fingers 98 and keep the connector in place during operation and use. The edge latches themselves are resiliently biased outwardly but can be pushed inwardly toward the housing and the center of the connector 12 when engaging or disengaging the connector with respect to the electronic machine. The receptacles have slots 104 within which the edge latches 74 are located when coupling of the mating members is desired. In order to push the connector with its clips into the receiving slots of the receptacle, the operator will preferably press against the edge latches and push them slightly inward relative to the connector for full insertion of the edge latches into the receiving slots. The operator then releases the edge latches and they resiliently spring out to their biased position to have their notches engage the fingers of the receiving slot to hold the inserted connector firmly in the receptacle by a restrictive force as well as an interference fit. When the operator wants to remove the connector 12, he simply presses in with his fingers on the edge latches, again moving them in towards the connector housing which allows them to relieve the force and to clear the fingers at the receiving slots after which he may withdraw the connector from the receptacle.

There is an obvious need in some applications to stack multiple units of single connectors on top of one another and insert them as an assembled unit into a corresponding two-dimensional array of contacts within the receptacle. There are two problems associated with this. The first is to provide a means for keeping the stack of connectors, for instance three as shown in the attached drawings, all together as one unit so they will not inadvertently become separated or misaligned. When three connectors are stacked together as a unit for simplicity and safety of installation, they should remain together as one stacked connector assembly. The second difficulty is that each of the single connectors that make up the stacked connector assembly must be engaged and disengaged with retention fingers of the receptacle. However, each single module connector has a pair of edge latches, and it is extremely difficult to utilize all three pairs of edge latches when installing and withdrawing such a stacked connector assembly. The clips, as described above, are used to overcome both of these difficulties.

The clips of the present invention enable only one of the pairs of edge latches in a stacked assembly of connectors to be activatable when engaging and disengaging the assembly of connectors with the contacts of the receptacle. The clip disables all of the pairs of edge latches except for one. Thus when the operator installs an assembly of stacked connectors 16, all he has to worry about is engaging and disengaging one pair of edge latches with respect to the receptacle just as he would with the installation of a single connector. The clip is placed around all of the other edge latches so that they are biased inward inside of the clip and therefore do not touch or engage the fingers of the receptacle. In other words, all of the latches but the ones that are actually being used for coupling purposes are placed in an inactive position inside the clips.

The method includes a plurality of steps, the first of which is providing a plurality of like connectors with edge latches essentially as described above. The method then includes the step of placing the plurality of the like connectors in a stack. A pair of clips, constructed, for example, in accordance with either of the two embodiments of the invention as described above, are then provided. The method then includes the step of positioning the pair of clips in operative association with the edge latches of the plurality of connectors in a stack to apply an inwardly directed force to the plurality of edge latches in the stack whereby only one edge latch along each edge of the stack is resiliently biased outwardly. The stack of connectors with their pair of clips is then inserted into an operative engagement with the receptacle of an electronic machine having fingers to contact the edge latches at notches formed in the edge latches to thereby apply a force thereto tending to preclude withdrawal of the stack of connectors and its clips. The electronic machine may then be utilized. Thereafter, a force is applied to the edge latches contacted by the fingers to disengage the edge latches from the fingers and thereby remove the pressure tending to preclude withdrawal of the stack of connectors and its clips from the electronic machine. The stack of connectors and its clips are then withdrawn from operative engagement with the electronic machine. The method of the present invention is essentially the same for either disclosed embodiment.

The present disclosure includes that information contained in the appended claims as well as that in the foregoing description. Although the invention has been described in its preferred forms or embodiments with a certain degree of particularity, it is understood that the present disclosure of the preferred form has been made only by way of example and that numerous changes in the details of construction, fabrication and use, including the combination and arrangement of parts and method steps, may be resorted to without departing from the spirit and scope of the invention.

What is claimed is:

1. In combination, a plurality of like connectors in an aligned stack and a pair of clips coupling together said connectors, each of said connectors comprising a housing molded of an electrically insulating material and shaped with parallel upper and lower surfaces and with spaced front and rear faces and with spaced edges, a plurality of apertures formed into said front face in a linear array with their axes in a plane parallel with and between said upper and lower surfaces, an electrically conductive female contact located in each of said apertures adapted to receive associated electrically conductive male contacts, each said housing having a latch plate secured to its upper surface with resilient edge latches positioned adjacent its edges and within its plane, each said edge latch having a central extent being movable toward said housing upon the application of pressure and being resiliently movable away from said housing upon the removal of the pressure; and each clip of said pair of clips comprising an internal section, an external section parallel with said internal section and an intermediate section joining said internal and external sections in a U-shaped configuration, each clip also being positioned with its internal and external sections positioned in association with edge latches along one edge of said plurality of connectors in the aligned stack so as to couple together said connectors and to apply an inwardly directing compressive pressure to a plurality of edge latches in the stack whereby only one edge latche along each said edge of the stack is resiliently biased outwardly for the removable coupling of said stack of connectors and their clips to an associated electronic machine.

2. The combination as set forth in claim 1 wherein said clips of said pair of clips are identically shaped whereby, when positioned in association with the stack of connectors, the edge latch of the uppermost connector along one edge of said stack and the edge latch of the lowermost connector along the other edge of the stack are resiliently biased outwardly.

3. The combination as set forth in claim 1 wherein the clips of said pair of clips are similarly shaped whereby, when positioned in association with a stack of connectors, the edge latches of the uppermost connector of the stack are resiliently biased outwardly.

4. In combination, a plurality of connectors and a plurality of clips for coupling together said connectors in a stack, each of said connectors comprising a housing fabricated of an electrically insulating material and shaped with parallel upper and lower surfaces and with spaced front and rear faces and with spaced edges, each said housing having resilient edge latches positioned adjacent its edges, each said edge latch having an extent movable toward said housing upon the application of pressure and resiliently movable away from said housing upon the removal of the pressure; and each of said clips comprising sections formed in a U-shaped configuration, each pair of said clips being positionable in operative association with the edge latches of a plurality of connectors in a stack so as to couple together the connectors and to apply an inwardly directing compressive pressure to a plurality of edge latches in the stack whereby one edge latch along each edge of a stack of connectors may be resiliently biased outwardly.

5. The combination as set forth in claim 4 wherein each of said connectors includes a plurality of apertures formed into said front face in a linear array between said upper and lower surfaces and an electrically conductive female contact located in each of said apertures and adapted to receive associated electrically conductive male contacts.

6. The combination as set forth in claim 4 and further including a plate secured to one said surface of each said housing with the edges of each said plate formed as said edge latches.

7. The combination as set forth in claim 4 wherein said clips of each pair of clips are identically shaped with their internal sections extending vertically to a height less than the vertical height of the stack of connectors to be coupled whereby, when positioned in association with a stack of connectors, the edge latch of the uppermost connector along one edge of the stack and the edge latch of the lowermost connector along the other edge of the stack may be resiliently biased outwardly.

8. The combination as set forth in claim 4 wherein the clips of each pair of clips are similarly shaped with their internal sections extending upwardly vertically less than the vertical height of the stack of connectors to be coupled whereby, when positioned in association with a stack of connectors, the edge latches of the uppermost connector of the stack may be resiliently biased outwardly.

9. The combination as set forth in claim 4 and further including an exteriorly directed notch formed in each said latch means for receiving a locking finger when the stack is received by an electronic machine.

10. The combination as set forth in claim 4 wherein each said clip comprises an internal section, an external section parallel with said internal section and an intermediate section joining said internal and external sections to form the U-shaped configuration.

11. The combination as set forth in claim 10 and further including parallel ridges formed in one of said parallel sections facing toward the other of said parallel sections for separating the connectors of the stack to be coupled.

12. The combination as set forth in claim 11 and further including additional parallel ridges formed in one of said parallel sections at its upper and lower edges and facing toward the other of said parallel sections for coupling the uppermost and lowermost connectors of the stack to be coupled.

13. For use in combination with a plurality of connectors of the type formed with a housing molded of an electrically insulating material and shaped with parallel upper and lower surfaces and with spaced front and rear faces and with spaced edges, a plurality of electrically conductive contacts located in the front face adapted to couple with associated electrically conductive contacts, each of the housings having resilient edge latches positioned adjacent its edges, each of the edge latches having a central extent being movable toward the housing upon the application of force and being resiliently movable away from said housing upon the relieving of the force, improved clip means comprising an internal section, an external section parallel with said internal section and an intermediate section joining said internal and external sections in a U-shaped configuration, a pair of said clip means being positionable with their internal and external sections in operative association with the edge latches of a plurality of connectors in a stack so as to couple together the connectors of their associated stack and to apply an inwardly directed compressive force to a plurality of edge latches in the stack of connectors whereby one edge latch along each edge of a stack of connectors is resiliently biased outwardly for the coupling of the stack of connectors to an associated electronic machine.

14. The clip means as set forth in claim 13 and further including parallel ridges formed in said exterior sections facing toward said interior section for separating the connectors of the stack to be coupled.

15. The clip means as set forth in claim 13 and further including parallel ridges formed in said exterior sections at their upper and lower edges and facing toward the interior sections for coupling to the stack of connectors the uppermost and lowermost connectors of the stack being coupled.

16. The clip means as set forth in claim 13 wherein the clip means of each pair of clips means are identically shaped whereby, when positioned in association with a stack of connectors, the edge latch of the uppermost connector along one edge of the stack and the edge latch of the lowermost connector along the other edge of the stack are resiliently biased outwardly.

17. The clip means as set forth in claim 13 wherein the clip means of each pair of clip means are similarly shaped whereby, when positioned in association with a stack of connectors, the uppermost edge latch of each edge of the stack are resiliently biased outwardly.

18. A method of coupling together, with clips, a plurality of like connectors in a stack, said method including the steps of:

providing a plurality of connectors, each of the connectors comprising a housing method of an electrically insulating material and shaped with parallel upper and lower surfaces and with spaced front and rear faces and with spaced edges, each housing having resilient edge latches positioned adjacent its edges, each edge latch having an extent movable toward the housing upon the application of an inwardly directed force and resiliently movable away from the housing upon the relieving of the force;

placing a plurality of the like connectors in a stack;

providing a pair of clips, each of the clips comprising sections formed in a U-shaped configuration;

positioning the pair of clips in operative association with the edge latches of a plurality of connectors in a stack to apply an inwardly directed force to a plurality of edge latches in the stack whereby only one edge latch along each edge of the stack is resiliently biased outwardly.

19. The method as set forth in claim 18 and further including the step of inserting the stack of connectors with its pair of clips into an operative engagement with an electronic machine having fingers to contact the edge latches and apply a force thereto tending to preclude withdrawal of the stack of connectors and its clips.

20. The method as set forth in claim 19 and further including the step of applying an inwardly directed force to the edge latches contacted by the fingers to disengage the edge latches from the fingers and thereby remove the force tending to preclude withdrawal of the stack of connectors and its clips from the electronic machine.

21. The method as set forth in claim 20 and further including the step of withdrawing the stack of connectors and its clips from operative engagement with the electronic machine.

* * * * *